US005357045A

United States Patent [19]

Tabei

[11] Patent Number: 5,357,045

[45] Date of Patent: Oct. 18, 1994

[54] REPETITIVE PCM DATA DEVELOPING DEVICE

[75] Inventor: Kazuhiko Tabei, Tokyo, Japan

[73] Assignee: NEC Corporation, Tokyo, Japan

[21] Appl. No.: 964,615

[22] Filed: Oct. 22, 1992

[30] Foreign Application Priority Data

Oct. 24, 1991 [JP] Japan ..... 3-277995
Dec. 24, 1991 [JP] Japan ..... 3-356196

[51] Int. Cl.[5] ..... G10H 1/057; G10H 7/00
[52] U.S. Cl. ..... 84/603; 84/627
[58] Field of Search ..... 84/603, 627

[56] References Cited

U.S. PATENT DOCUMENTS 4,882,963 11/1989 Ichiki ..... 84/603
4,916,996 4/1990 Suzuki et al. ..... 84/603
5,147,970 9/1992 Obata ..... 84/603
5,194,681 3/1993 Kudo ..... 84/603

*Primary Examiner*—Stanley J. Witkowski
*Attorney, Agent, or Firm*—Whitham, Curtis, Whitham & McGinn

[57] ABSTRACT

The repetitive PCM data developing device of this invention extracts segment waveform PCM data which becomes basic structural part of repetitive PCM data from the waveform of PCM data converted from analog sound signal such as a melody and further extracts envelope PCM data showing the shape of envelope curve from the waveform of PCM data. And the envelope PCM data is divided into blocks for every equal part of amplitude, the segment waveform corresponding to the block is selected from the segment waveform PCM data, and the waveform information including the shape of segment waveform, frequency, amplitude and repetitive number is prepared for every block. Lastly, based on the waveform information, the repetitive PCM data having the blocks combined and continued is prepared.

9 Claims, 8 Drawing Sheets

REPETITIVE PCM DATA DEVELOPING DEVICE

BACKGROUNDS OF THE INVENTION

1. Field of the Invention

This invention relates to a device for digitizing and processing sounds such as melodies and imitation sounds, and particularly to a repetitive PCM data developing device for generating repetitive PCM data used for melody ICs.

2. Description of the Prior Art

The melody IC is different from a tape recorder or the like and is excellent in durability because it does not have mechanical moving parts and in finding the start of music and selecting music. Therefore, it is built in various equipment including a telephone and extensively used as a sound source for background music.

Particularly for melody data, in order to improve sound quality, it is necessary to increase a bit number for analog-digital conversion and sampling frequency. Then, it results in increasing the required memory capacity, decreasing the amount of music which can be stored in the memory. Therefore, it is significant to provide the so-called data compression technology to decrease the required memory capacity without degrading sound quality.

A tone quality of a melody or imitation sound can be generally represented by a systematic waveform such as a sine wave, chopping wave, and square wave. For example, like the original waveform of a melody or imitation sound as shown in FIG. 6A, when the original waveform is a repetition of a similar waveform, by seizing the basic part of the similar waveform as one segment waveform, the original waveform can be closely resembled by repeating the segment waveform as shown in FIG. 6B. A data compression method which has the original waveform closely resembled by repeating the segment waveform is called a repetitive PCM method. And, the repetitive PCM data can be represented by a data form such as (PCM data of segment waveform) x (repetitive number of segment waveform), so that data volume can be substantially decreased as compared with the case that all waveforms are represented by PCM data.

For example, a melody or imitation sound having envelope curve as shown in FIG. 7A will be considered. When the envelope curve representing a tone quality of the melody or imitation sound shown in FIG. 7A is represented by the repetitive PCM method, it can be closely resembled by combining the block data represented by (segment waveform)×(repetitive number) as shown in FIG. 7B.

To prepare data of a melody or imitation sound by the repetitive PCM method, a block data is prepared by entering information of segment waveform (waveform information, amplitude and frequency) and repetitive number information, and such blocks are combined to finish a final data.

The repetitive PCM method is a method generally used for a melody IC or the like. And, in preparing this type of a melody or imitation sound data, the original sound waveform of a melody or imitation sound is shown on the display, and the waveform information obtained by observing the display is entered in a personal computer and simultaneously it is listened to, and the waveform information is revised to produce the repetitive PCM data which is similar to the original sound.

As described above, in a conventional method, to produce a melody or imitation sound, the original sound waveform of the melody or simulation sound displayed on the CRT is observed to obtain waveform information (segment waveform shape, frequency, amplitude, and repetitive number) and the data is entered to prepare block data, which are combined to produce the repetitive PCM data. But, a recent product adapting a melody IC is required to include various kinds of tone quality within a long-hour melody and imitation data. Therefore, for the analysis of the original sound of a melody or imitation sound, a job for obtaining the waveform information, and a job for combining block data, lots of manpower are required. Thus, it has a problem that many job steps are required.

For example, to prepare data of one musical note, 5 it is necessary to enter waveform information of plural blocks according to similar envelope curves. And to complete the melody of one piece of music, the above steps are conducted on many and various musical notes based on the musical score of the melody. Thus, enormous working volume and working hours are required.

SUMMARY OF THE INVENTION

An object of this invention is to provide a repetitive PCM data developing device which can prepare a repetitive PCM data simply and in a short time in response to various complex sound sources.

The repetitive PCM data developing device according to this invention to complete the above object includes a means for converting analog sound signal into PCM data, a means for extracting segment waveform PCM data which becomes basic a structural part of repetitive PCM data from the above PCM data waveform, a means for extracting envelope PCM data indicating the shape of envelope curve from the waveform of the above PCM data, a means for dividing the above envelope PCM data by dividing into blocks for every equal part of amplitude, a means for selecting segment waveform corresponding to the above block from the above segment waveform PCM data and for preparing waveform information per the above block, and a means for preparing continuous repetitive PCM data by combining the above blocks based on the above waveform information.

And, it also includes a means for showing a waveform of the above PCM data and a means for designating a segment waveform area from the waveform of the above PCM data displayed.

Further, the above waveform information consists of data showing the shape of segment waveform in the above block, data showing the frequency of the segment waveform, data showing the amplitude of the segment waveform, and data showing the repetitive number of the segment waveform.

Further, it is provided with a means for converting the above prepared repetitive PCM data into PCM data, a means for converting the PCM data into an analog sound signal, and a means for converting into a format suitable to the format of equipment into which the above repetitive PCM data is incorporated.

And, it includes a means for storing the above PCM data, a means for storing the above waveform information, and a means for storing the above repetitive PCM data.

The repetitive PCM data developing device according to another embodiment of this invention for completing the above object includes a means for obtaining a musical note data and its envelope PCM data from musical score information previously prepared, a means for storing the above musical note data and envelope PCM data, a means capable of editing data by indicating the content of the above musical note data and envelope PCM data, and a means for preparing the repetitive PCM data based on each musical note data and envelope PCM data in the above musical score information.

And, the above repetitive PCM data preparing means obtains data indicating the shape of the segment waveform PCM data of each musical note obtained based on the above each musical note data and envelope PCM data, data indicating frequency, data indicating amplitude and data showing repetitive number, and prepares the repetitive PCM data by combining the waveform information of each musical note.

The means for generating the above repetitive PCM data stores the above repetitive PCM data and the block data structured by combining the waveform information of the continuous plural musical notes in a state further combined in plurality.

Further, it includes a means for converting the above repetitive PCM data into an ordinary PCM data and a means for listening in trial to the synthetic sound of the converted PCM data.

Other objects, features and effects of this invention will be understood from the following detailed description.

DESCRIPTION OF THE PREFERRED EMBODIMENT

Figure 1:
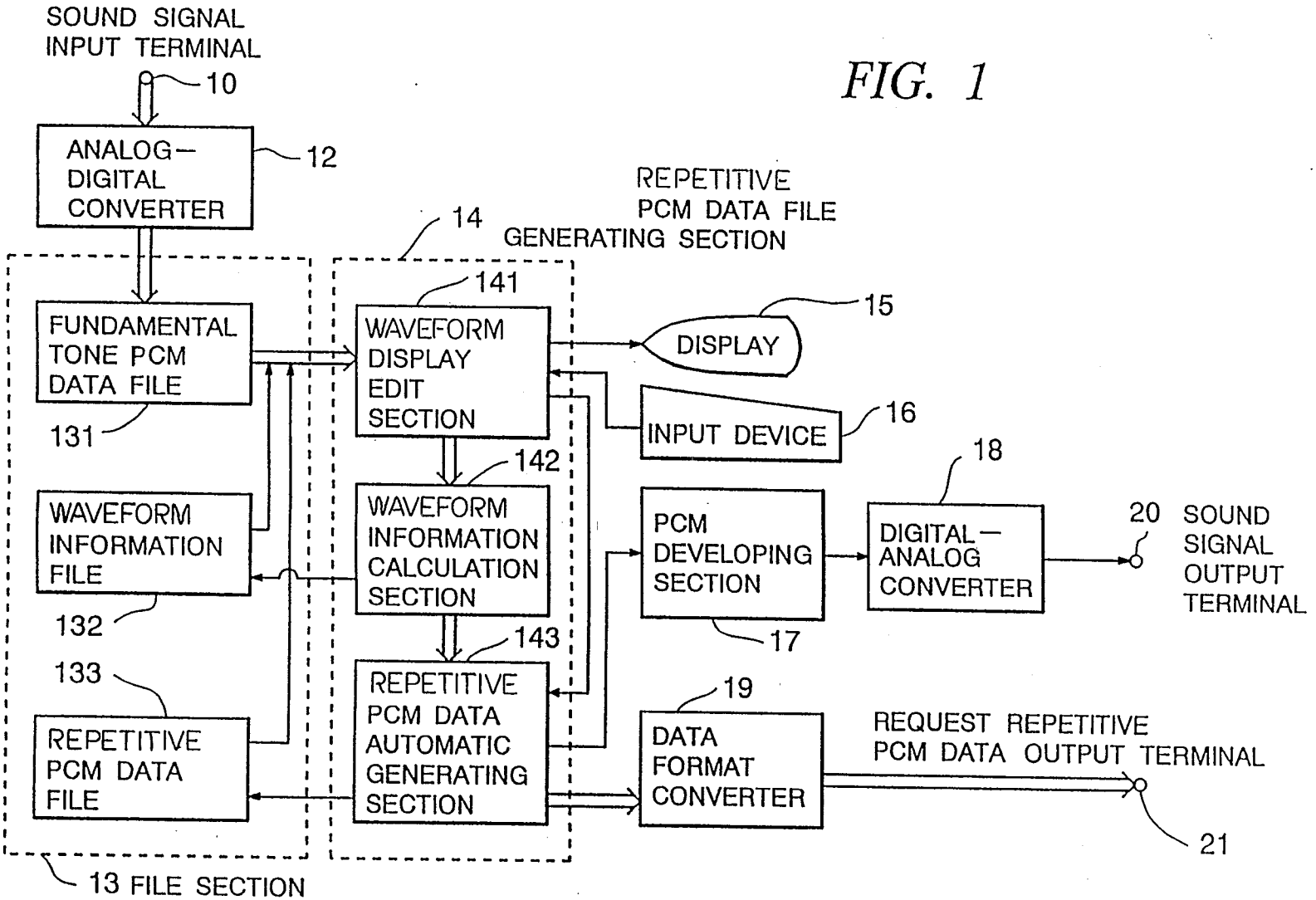
FIG. 1 is a block diagram showing the structure of the repetitive PCM data developing device according to a first embodiment of this invention.

A preferred embodiment of the repetitive PCM data developing device according to this invention will be described with reference to the drawings. FIG. 1 is a structural block diagram showing a first embodiment of the repetitive PCM data developing device of this invention.

The repetitive PCM data developing device consists of sound signal input terminal 10 for entering analog signal of the fundamental tone of a melody or imitation sound from musical instrument as sound signal, analog-digital converter 12 for converting the sound signal entered from the sound signal input terminal 10 into PCM data and outputting, the same file section 13 for storing PCM data and various calculation data from the analog-digital converter 12, repetitive PCM data generating section 14 for preparing repetitive PCM data from the PCM data stored in the file section 13, display 15 such as CRT for displaying fundamental tone PCM data, input device 16 such as a keyboard for effecting data entry, PCM developing section 17 for developing the repetitive PCM data into an ordinary PCM data, digital-analog converter 18 for converting the digital PCM data into an analog sound signal, data format converter 19 for converting the repetitive PCM data into a format suitable for a target equipment (e.g. melody IC), sound signal output terminal 20, and repetitive PCM data output terminal 21.

And, the file section 13 consists of fundamental tone PCM data file 131 for storing PCM data converted from the sound signal in the analog-digital converter 12, waveform information file 132 for storing waveform information obtained in the repetitive PCM data generating section 14, and repetitive PCM data file 133 for storing the prepared repetitive PCM data.

The repetitive PCM data generating section 14 consists of waveform display editing section 141, waveform information calculating section 142, and repetitive PCM data automatic generating section 143. This repetitive PCM data generating section 14 automatically prepares repetitive PCM data. For automatic preparation of repetitive PCM data, envelope PCM data is made into a block for every part with equal PCM data value, and waveform information (segment waveform PCM data, frequency data, amplitude data and repetitive number data) is prepared for every block by the waveform information calculating section 142 to store into the waveform information file 132 of the file section 13. Among the waveform information, frequency data is a repetitive number of segment waveform PCM data per second. The amplitude data is a value obtained by dividing the amplitude value of envelope data of the applicable block with a maximum amplitude value among segment waveform PCM data. And, the repetitive number data is a repetitive number of segment waveform PCM data for each block. In the PCM data automatic generating section 143, these waveform information blocks are combined to prepare repetitive PCM data.

Figure 2:
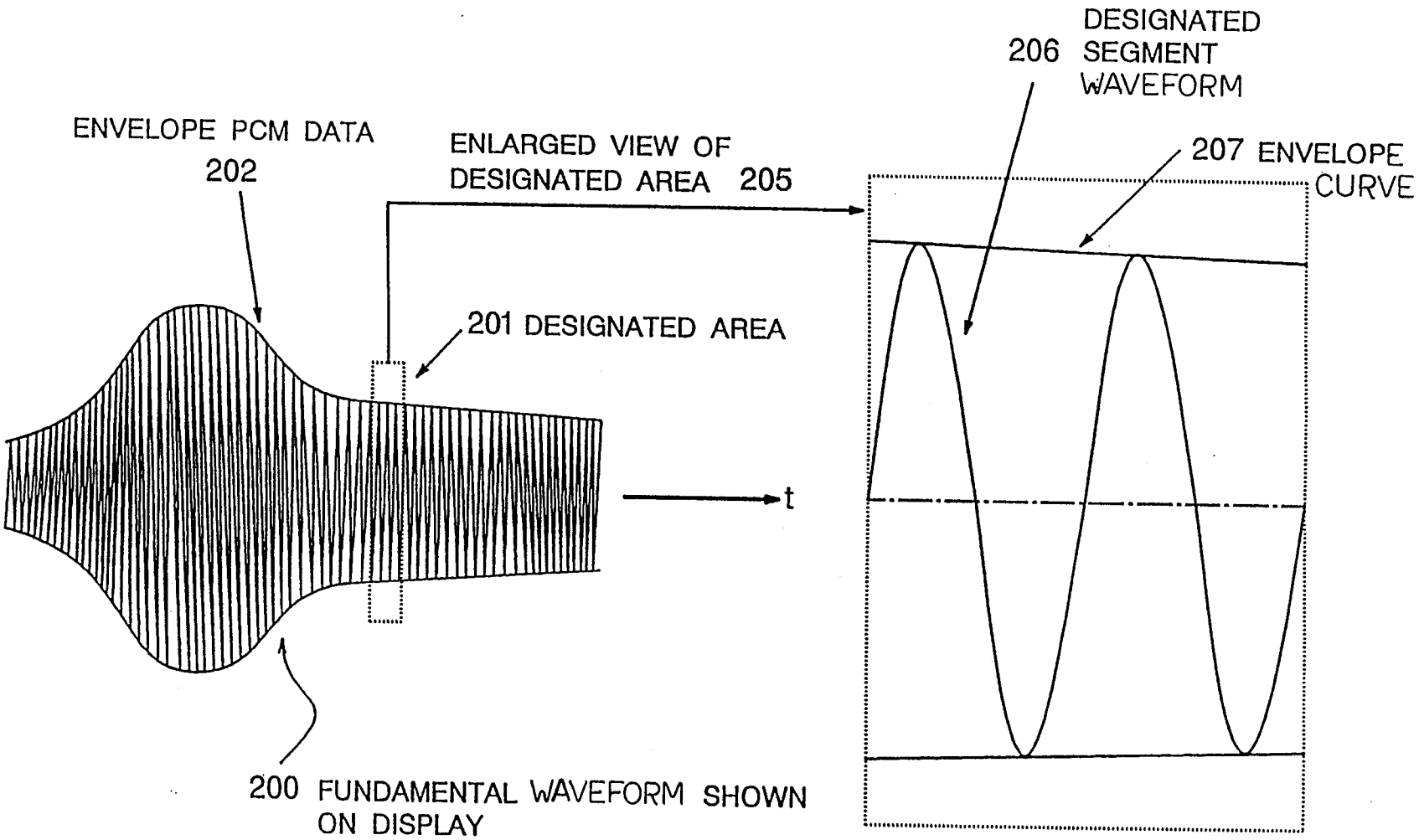
FIG. 2 is an explanatory view describing the designating method of segment waveform PCM data and envelop PCM data with the repetitive PCM data developing device.
Figure 3A:
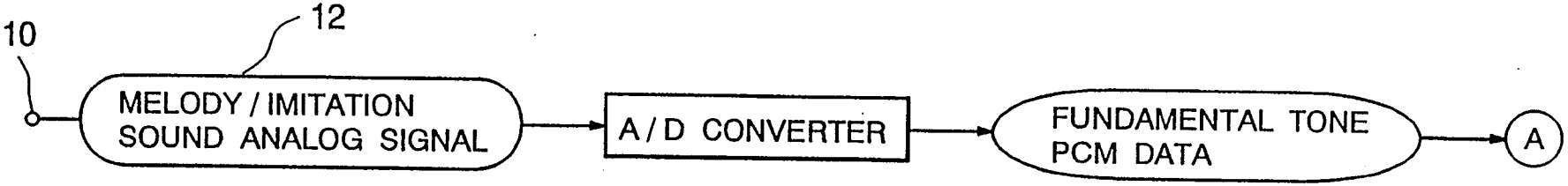
FIGS. 3A–3D are a block diagram showing the transition state of signal and data in the device of the first embodiment.
Figure 3C:
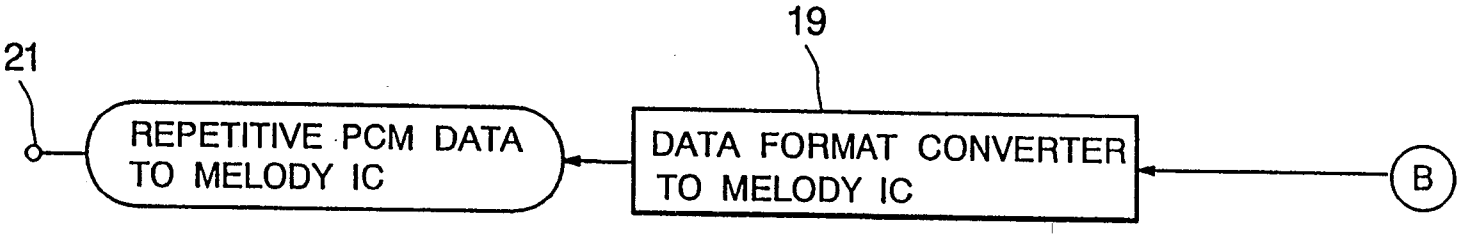
Figure 3D:
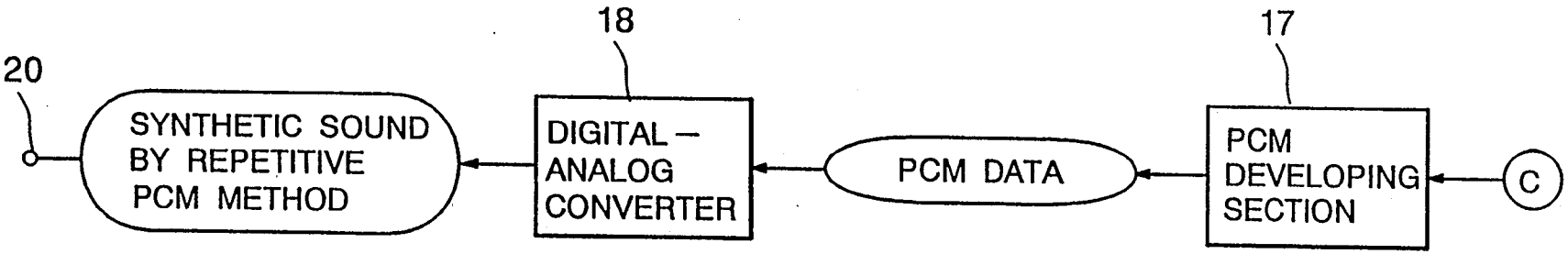
Figure 3B:
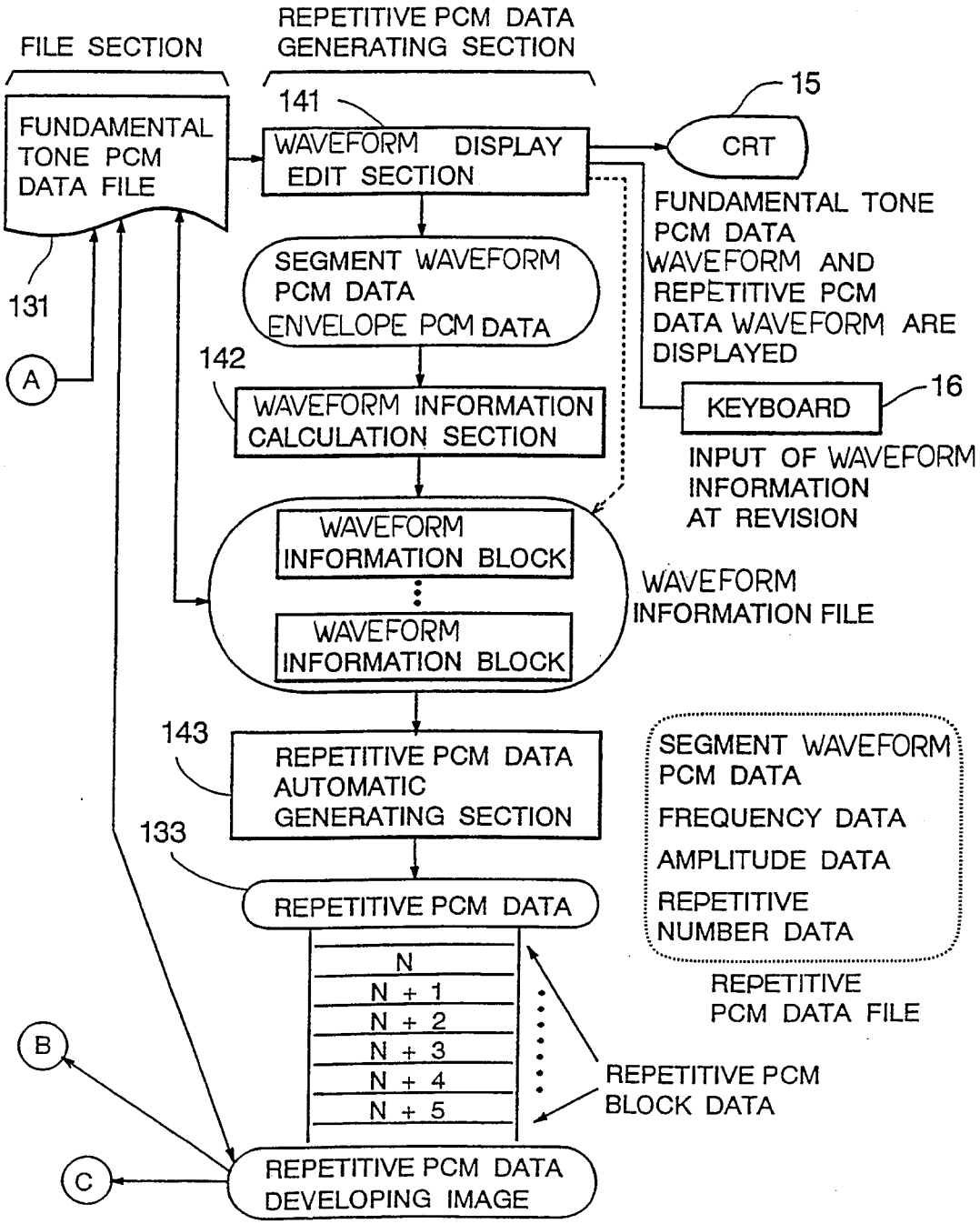

Now, the operation of the first embodiment will be described with reference to FIG. 1, FIG. 2 and FIGS. 3A–3D. FIG. 2 is a diagram illustrating a designating method of segment waveform PCM data and envelop PCM data. FIGS. 3A–3D are block diagrams showing a transition state of signal and data in the device according to the first embodiment.

The analog signal of fundamental a tone of a melody or imitation sound from a musical instrument or the like is entered through the sound signal input terminal 10 and the analog signal is converted into PCM data in the analog-digital converter 12. This is stored as fundamental tone PCM data in the fundamental tone PCM data file 131 within the file section 13. This stored fundamental tone PCM data is shown on the display 15 such as CRT in the waveform display editing section 141 within the repetitive PCM generating section 14.

FIG. 2 shows one example of waveform of the fundamental tone PCM data shown in the display 15. An operator observes waveform 200 of this fundamental tone PCM data and designates area 201 designating partial waveform to be determined as segment waveform (waveform for 1 cycle) with input device 16 such as a keyboard. Designation of this area results in extraction of PCM data corresponding to partial waveform of the designated area 201 among fundamental tone PCM data stored in the fundamental tone PCM data file 131. And, designation of the area shows enlarged view 205 of the designated area 201 shown in FIG. 2 on the display 15. Thus, all kinds of segment waveform 206 included in the fundamental tone PCM data are extracted and the obtained data is determined to be segment waveform PCM data.

Waveform data of an envelope curve is extracted from the waveform 200 of the fundamental tone PCM data shown on the display, and the obtained data is determined to be ° envelope PCM data. In the waveform 200 of the fundamental tone PCM data of FIG. 2, envelop PCM data 202 is extracted.

The segment waveform PCM data and envelop PCM data obtained as above are entered into the waveform information calculating section 142 for automatic preparation of repetitive PCM data.

In the waveform information calculating section 142, the envelope PCM data is made into a block for part of equal envelope PCM data value, i.e. part of equal amplitude from the entered envelope PCM data, and is divided into plural blocks. Further, from the entered segment waveform PCM data, a segment waveform corresponding to that block is selected and combined to prepare waveform information for every block. The waveform information for every block is stored in the waveform information file 132 of the file section 13. This waveform information includes segment waveform PCM data, frequency data, amplitude data and repetitive number data of segment waveform.

More specifically, the segment waveform PCM data is a data showing the shape of segment waveform for every block (e.g. sine wave, chopping wave, and square wave). Frequency data is a repetitive number per second of the segment waveform PCM data. Amplitude data is a value obtained by dividing the amplitude value of the envelope PCM data of the applicable block with the maximum value of the segment waveform PCM data. The repetitive number data is a repetitive number of the segment waveform PCM data in each block.

The waveform information of the block thus obtained is entered into the repetitive PCM data automatic generating section 143 and each block is combined. The combination of each block is made by block number designated for every block (N, N+1, N+2 ..... in FIGS. 3B correspond to block number). Thus, continuous repetitive PCM data is automatically prepared. This repetitive PCM data is stored in repetitive PCM data file 133 of the file section 13.

In the process so far, repetitive PCM data is prepared automatically. And in order to make the prepared repetitive PCM data resemble the fundamental tone of a melody or imitation sound, debugging is effected finally. This debugging procedure will be described.

The fundamental tone PCM data stored in the fundamental tone PCM data file 131 within the file section 13, the waveform information stored in the waveform information file 132, and the repetitive PCM data stored in the repetitive PCM data file 133 are shown on display 15 by the waveform display editing section 141. And, two or more data can be shown on the same screen by a switching operation.

A first method of debugging simultaneously shows the fundamental tone PCM data and repetitive PCM data on the display 15 and compares the shapes to debug. When it is found that the shapes are different, the waveform information of the applicable block is shown on the same screen to effect debugging.

A second method of debugging outputs the repetitive PCM data as analog audio signal from audio signal output terminal 20 through PCM developing section 17 and digital-analog converter 18, and the audio signal is listened and compared with the fundamental tone. And, on the display 15, the waveform information is debugged to make it resemble the fundamental tone.

As described above, the finally prepared repetitive PCM data is converted into a format suitable for storage by the data format converter 19 and outputted from the repetitive PCM data output terminal 21 to be stored into equipment such as a melody IC.

The repetitive PCM data generating section 14 which is a feature of this device can be realized through software.

According to the repetitive PCM data developing device of this embodiment, in preparing the repetitive PCM data resembling tone quality of a melody or imitation sound of musical instrument, analyzing time of fundamental tone data and preparing time and man-days of the repetitive PCM data can be shortened.

Figure 4:
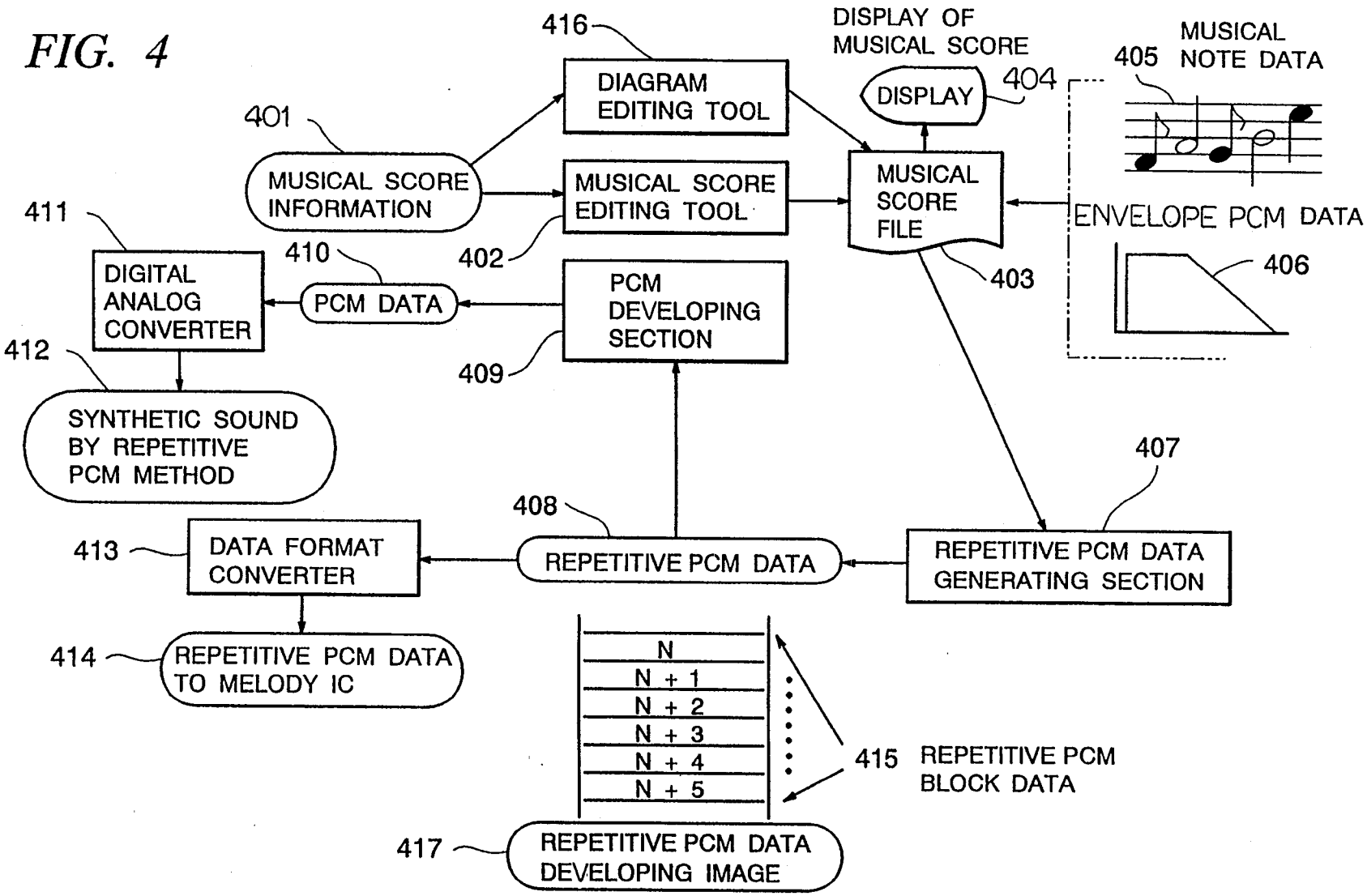
FIG. 4 is a block diagram showing the structure of the repetitive PCM data developing device according to a second embodiment of this invention.
Figure 5:
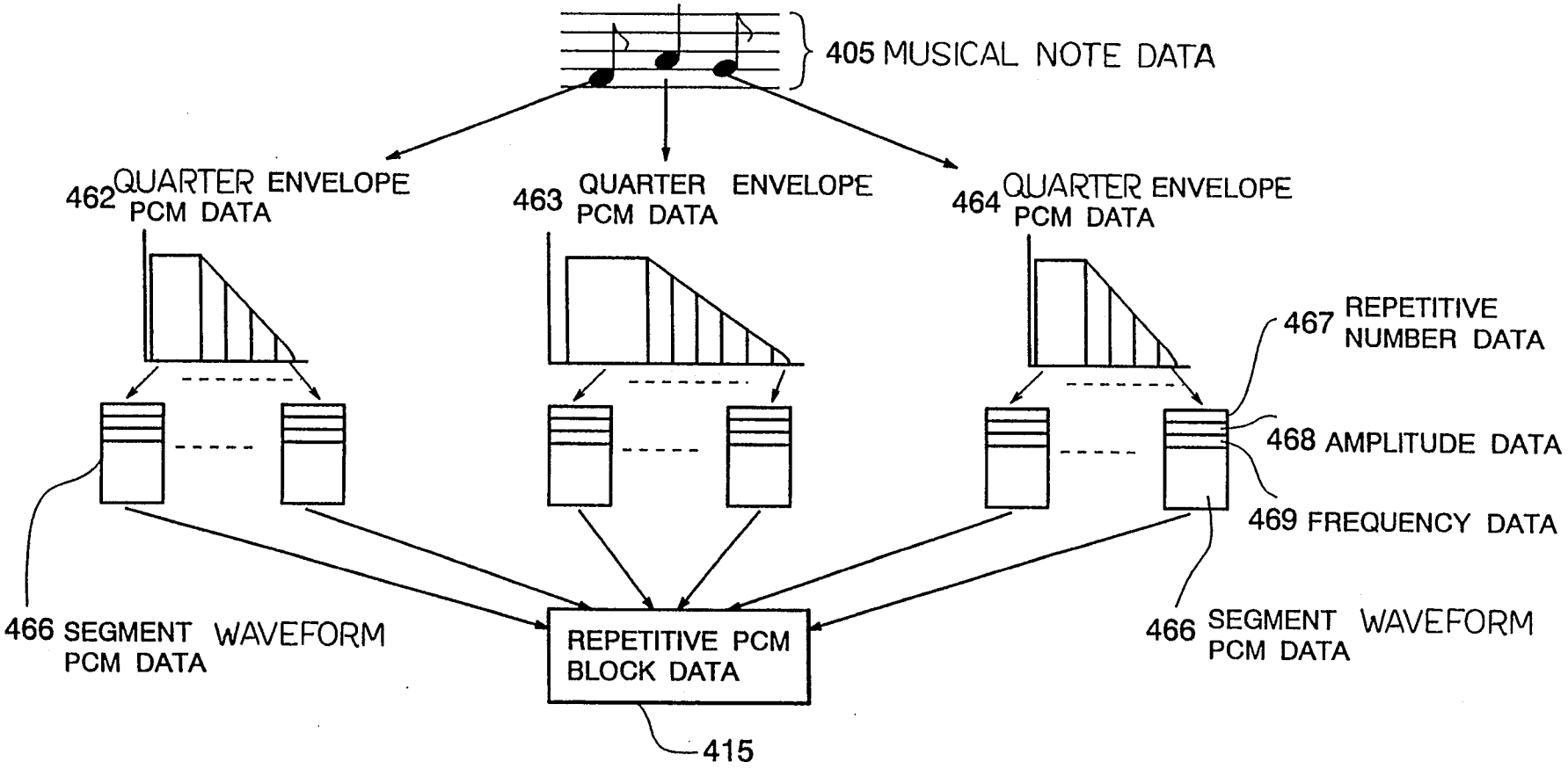
FIG. 5 is an illustrative view describing the relation between the musical note data and repetitive PCM data.
Figure 6A:
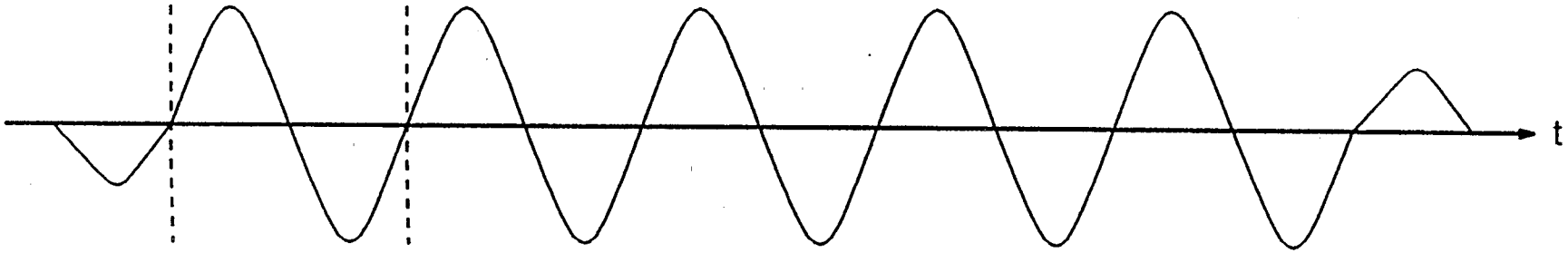
FIG. 6A ( PRIOR ART )
FIGS. 6A–6B are diagrams illustrating the repetitive PCM method.
Figure 6B:
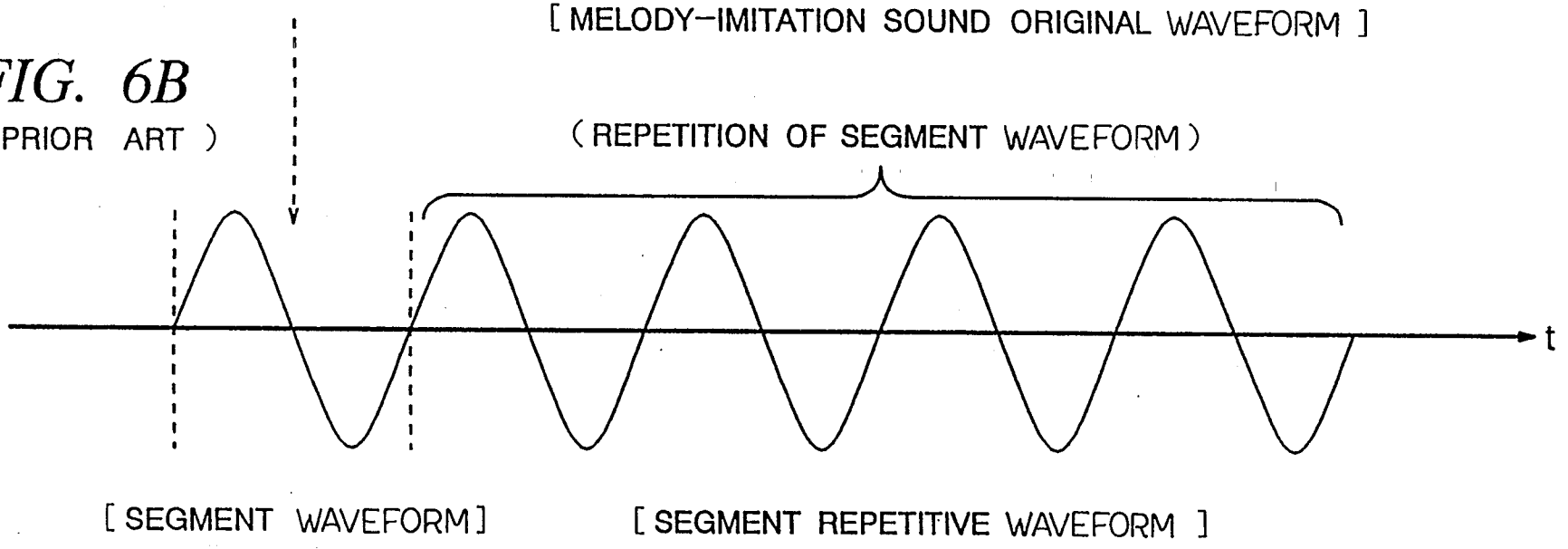
FIG. 6B ( PRIOR ART )
Figure 7A:
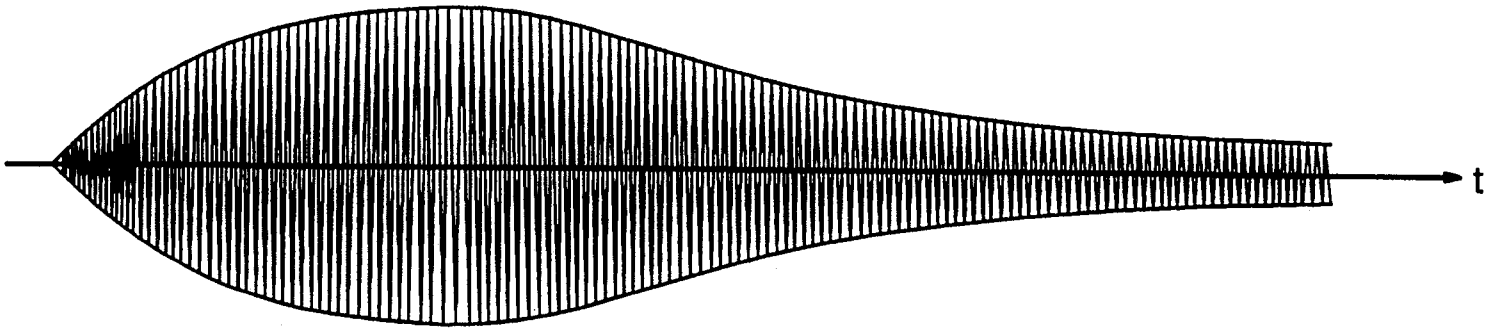
FIG. 7A ( PRIOR ART )
FIGS. 7A–7B are diagrams illustrating an example of envelope curve of PCM data and block data.
Figure 7B:
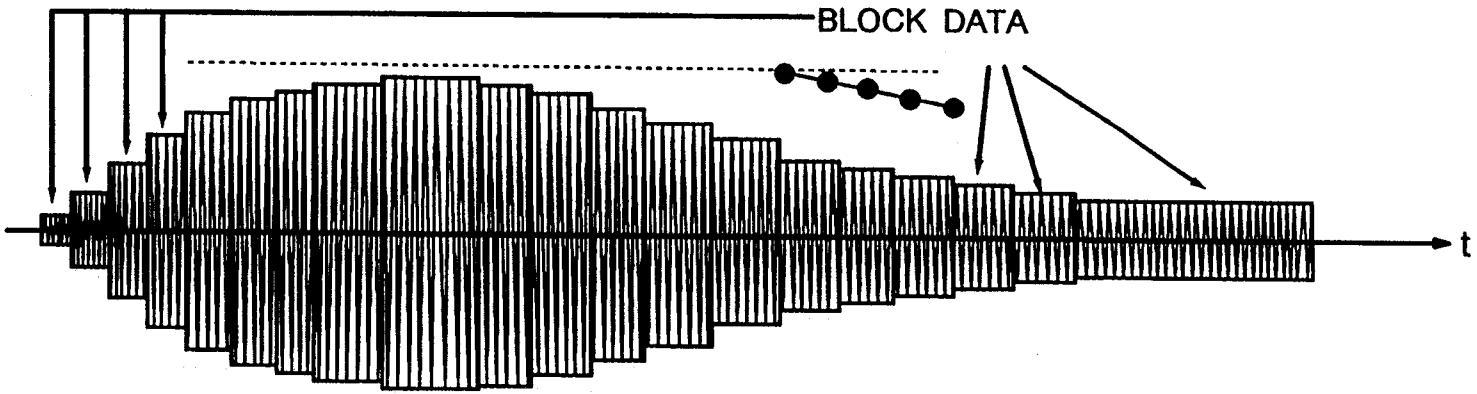
FIG. 7B ( PRIOR ART )

Then, a second embodiment of this invention will be described with reference to FIG. 4 and FIG. 5. FIG. 4 is a structural block diagram illustrating the second embodiment of the repetitive PCM data developing device of this invention.

The repetitive PCM data developing device of the second embodiment includes musical score editing means 402 to obtain musical note data 405 from musical score information 401, figure editing means 416 to obtain envelope PCM data 406 from the musical score information 401, musical score file 403 to store the musical note data 405 and envelop PCM data 406, display 404 such as CRT to show the content of the musical note data 405 and envelope PCM data 406, repetitive PCM data generating means 407 for preparing repetitive PCM data 408 based on each musical note data 405 and envelope curve data 406 within the musical score file 403, PCM developing section 409 for developing and converting the repetitive PCM data 408 into ordinary PCM data 410, digital-analog converter 411 for converting the PCM data 410 from the PCM developing section 409 into analog signal 412, and data format converter 413 for converting the repetitive PCM data 408 into data format suitable for equipment such as a melody IC.

The operation of the repetitive PCM data developing device of the above second embodiment will be described. The musical note data 405 is extracted by the musical score editing means 402 from the musical score information 401 of a melody to be prepared, and the envelope PCM data 406 is extracted by the figure editing means 416. Here, the musical note data 405 includes a position (pitch of musical note) in kinds of musical notes and staffs of musical notes. The envelop PCM data 406 is extracted for every musical note.

The extracted musical note data 405 and envelope PCM data 406 are stored in the musical score file 403, and the content is shown on the display. Then, figure editing of the envelope curve for preparing a desired tone quality and musical score editing can be made on the display 404.

The repetitive PCM data generating means 407 prepares the repetitive PCM data 408 based on each musical note data 405 and envelope PCM data 406 within the musical score file 403. This repetitive PCM data 408, as shown in FIG. 5, consists of parameters of segment waveform PCM data 466 having segment waveform shape PCM coded and frequency data 469, amplitude data 468, and segment waveform repetitive number data 467 parameter. Specifically, the repetitive PCM data generating means 407 obtains data 466 showing the shape of segment waveform PCM data of every musical note obtained based on each musical note data 405 and envelope PCM data 406, data 469 showing frequency, data 468 showing amplitude, and data 467 showing repetitive number and combines the waveform information of each musical note to prepare the repetitive PCM data 408. And, the repetitive PCM data 408, as shown in FIG. 5, is stored in the shape of repetitive PCM data developing image 417 having the repetitive PCM block data 415 structured by combining continuous plural musical note waveform information further combined in plural.

The repetitive PCM data 408 is developed to ordinary PCM data 410 in the PCM developing section 409, and converted into an analog signal in the digital-analog converter 411. And, the analog signal can be listened to as a synthetic sound 412 of repetitive PCM data through an amplifier and a speaker. As a result, if the sound is not as desired, the musical note data 405 and the envelope PCM data 406 are shown on the display 404 to make required modification, and the repetitive PCM data 408 is newly prepared.

The above processing is effected on all musical notes. The repetitive PCM data 408 of the completed melody is converted into a format suitable for equipment such as a melody IC in the data format converter 413 and ROMed.

In the repetitive PCM data developing device of the second embodiment, the digital-analog converter 411 and the display 404 are hardware and other parts are realized in software.

In the second embodiment, based on the musical score information of a melody desired to be produced, the repetitive PCM data can be automatically produced. Therefore, melody data can be produced in a short time and easily by the repetitive PCM data.

It should be noted that this invention can be variously modified other than the above described embodiments. Modification and variation of this invention without departing from the spirit and the scope of this invention are included in the scope of the claims.

What is claimed is:

1. A repetitive PCM data developing device comprising:

means for converting an analog sound signal into PCM data, means for extracting segment waveform PCM data for forming a predetermined structural part of repetitive PCM data from the waveform of said PCM data, means for extracting an envelope of said PCM data showing the shape of an envelope curve from the waveform of said PCM data, means for dividing said envelope of said PCM data into a plurality of blocks, each block of said plurality of blocks having a substantially uniform amplitude, means for selecting segment waveform corresponding to said blocks from said segment waveform PCM data and preparing waveform information for said each block, and means for preparing continuous repetitive PCM data by combining said blocks based on said waveform information.

2. A repetitive PCM data developing device according to claim 1, further comprising means for showing the waveform of said PCM data and a means for designating a region to be segment waveform from the waveform of said PCM data shown.

3. A repetitive PCM data developing device according to claim 1, wherein said waveform information includes data showing the shape of segment waveform in said block, data showing the frequency of the segment waveform, data showing the amplitude of the segment waveform, and data showing the repetitive number of the segment waveform.

4. A repetitive PCM data developing device according to claim 1, further comprising means for converting said prepared repetitive PCM data into PCM data, means for converting the PCM data into an analog sound signal, and means for converting said prepared repetitive PCM data into a format suitable for a format of equipment incorporating said repetitive PCM data.

5. A repetitive PCM data developing device according to claim 1, further comprising means for storing said PCM data, means for storing said waveform information, and means for storing said repetitive PCM data.

6. A repetitive PCM data developing device comprising:

means for obtaining musical note data and its envelope PCM data from previously prepared musical score information, means for storing said musical note data and said envelope PCM data, means, operatively coupled to said means for storing, for showing the content of said musical note data and said envelope PCM data to edit the data, and means, operatively coupled to said means for storing, for preparing repetitive PCM data based on each musical note data and envelope PCM data within said musical score information.

7. A repetitive PCM data developing device according to claim 6, wherein said repetitive PCM data preparing mean obtains data indicating a shape of segment waveform PCM data of each musical note obtained based on said each musical note data and envelope PCM data, data indicating frequency, data indicating amplitude and data showing repetitive number, and prepares the repetitive PCM data by combining the waveform information of each musical note.

8. A repetitive PCM data developing device according to claim 6, wherein said repetitive PCM data preparing means stores said repetitive PCM data and block data structured by combining the waveform information of the continuous plural musical notes in a state further combined in plurality.

9. A repetitive PCM data developing device according to claim 6, further comprising means for converting said repetitive PCM data into ordinary PCM data and means for listening in trial to synthetic sound of the converted PCM data.

* * * * *